US008733214B2

(12) United States Patent
Hsu

(10) Patent No.: US 8,733,214 B2
(45) Date of Patent: May 27, 2014

(54) WRENCH

(76) Inventor: Chang Hsueh-O Hsu, Taichung (TW)

( * ) Notice: Subject to any disclaimer, the term of this patent is extended or adjusted under 35 U.S.C. 154(b) by 252 days.

(21) Appl. No.: 13/485,974

(22) Filed: Jun. 1, 2012

(65) Prior Publication Data

US 2013/0319187 A1 Dec. 5, 2013

(51) Int. Cl.
*B25B 13/18* (2006.01)
*B25B 13/46* (2006.01)

(52) U.S. Cl.
CPC ..... *B25B 13/46* (2013.01); *B25B 13/18* (2013.01)
USPC ..... 81/126

(58) Field of Classification Search
USPC ..... 81/126–129, 134
See application file for complete search history.

(56) References Cited

U.S. PATENT DOCUMENTS 485,657 A * 11/1892 Reichling ..... 81/126
554,596 A * 2/1896 Geisel ..... 81/126
1,354,552 A * 10/1920 Hart ..... 81/127
1,602,620 A * 10/1926 Larson et al. ..... 81/127
1,660,208 A * 2/1928 Preining ..... 81/127
1,771,172 A * 7/1930 Fraser ..... 81/127
1,794,818 A * 3/1931 Abrahamson ..... 81/127
1,804,861 A * 5/1931 Dorn ..... 81/127
2,223,306 A * 11/1940 Mead ..... 81/127
2,285,603 A * 6/1942 Mead ..... 81/127
2,590,792 A * 3/1952 Reneer ..... 81/127
3,290,970 A * 12/1966 De Lucia ..... 81/127
3,572,190 A * 3/1971 Oeland, Jr. ..... 81/127
4,084,456 A * 4/1978 Pasbrig ..... 81/177.8
4,833,949 A * 5/1989 Piperkovski ..... 81/127
5,016,503 A * 5/1991 Morton ..... 81/127
6,131,491 A * 10/2000 Hirse ..... 81/99
6,145,415 A * 11/2000 Liu ..... 81/143
2001/0020404 A1* 9/2001 Chang-Kao ..... 81/127

* cited by examiner

*Primary Examiner* — David B Thomas

(57) ABSTRACT

The present invention provides a wrench which includes a movable jaw, a fixed jaw and a slidable member formed at the bottom portion of the movable jaw and slidably mounted to the main body. In the present invention, a toggle member can be driven to rotate through rotating a handle of the wrench, and the toggle member can smoothly move to and fro between a driving space and an evading space of the slidable member. Whereby, the present invention is simple in structure, has characteristics of smoothly engagedly-cooperative movements between parts of the wrench, so that it can make full use of the force applied by the user and has excellent effects of use.

7 Claims, 4 Drawing Sheets

WRENCH

BACKGROUND OF THE INVENTION

1. Field of the Invention

The present invention relates to a wrench.

2. Description of the Prior Art

A conventional wrench is subjected to be used through the cooperative engagement of a cam portion disposed at the bottom of a movable jaw and another cam portion disposed at the top of a handle. However, under a required huge torque, such an engagement between the cam portions can easily lead to the collapse of the cam portions and the abrasion of the cam portions after a prolonged use of the cam portions.

In this regard, a wrench disclosed in U.S. Pat. No. 1,434,754 is provided to improve the above problem, in which a spring is disposed in a slot, and rivets are secured to plates and located in the slot. However, since the cooperating projections are located below the slot, and so is the cam shaped projection, the force applied to the movable jaw by the cam shaped projection concentrates mostly at the cooperating projections, the cam shaped projection slantedly and downwardly push the cooperating projections, and only about half the force is used to drive the cooperating projections moving horizontally. In other words, when the wrench which is provided without the use of the engagement of the cam portions is used, it is difficult to operate because only a small part of the force is delivered to the movable jaw and the fixed jaw.

In addition, since the movable jaw and the fixed jaw are secured between two plates, two slots are required, and two rivets are secured to the movable jaw and the fixed jaw and are located in the slot, respectively, to complete the assembly of the wrench. The structure of the wrench is quite complex, thus increasing the manufacturing costs and assembly difficulty.

The present invention is, therefore, arisen to obviate or at least mitigate the above mentioned disadvantages.

SUMMARY OF THE INVENTION

The main object of the present invention is to provide a wrench which is simple in structure and has excellent effects of use.

To achieve the above and other objects, a wrench of the present invention includes a main body, a slidable member and a handle.

The main body has a fixed jaw.

The slidable member is formed at the bottom portion of the movable jaw and slidably mounted to the main body, and the slidable member defines a changeable opening with the fixed jaw.

The slidable member includes an upper small portion and a first lower enlarged portion, the upper small portion extends laterally from and is located at the bottom portion of the movable jaw, the upper small portion has a first end and a second end, the first lower enlarged portion extends laterally from and is located at the bottom portion of the upper small portion and is near the first end of the upper small portion, and the first lower enlarged portion has a first end and a second end.

A part of the upper small portion near the second end thereof and the first end of the first lower enlarged portion define a driving space, an another part of the upper small portion and the main body define an evading space, and the evading space is comparatively near the second end of the upper small portion.

The handle has a toggle member disposed at one end thereof. When the handle is at a driving position, the toggle member is located in the driving space and engages against the first end of the first lower enlarged portion, and the changeable opening has the smallest width. When the handle is at a releasing position, the toggle member is located away from the first end of the first lower enlarged portion and moves into the evading space from the driving space smoothly, and the movable jaw is capable of moving away from or toward the fixed jaw.

Whereby, the structure of the wrench of the present invention is simple, the manufacturing costs is decreased, and the force applied by the user can be sufficiently delivered to the movable jaw and the fixed jaw. Furthermore, the slidable member is provided with the evading space, so that the travel distance for which the movable jaw moves away from the fixed jaw is not limited.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
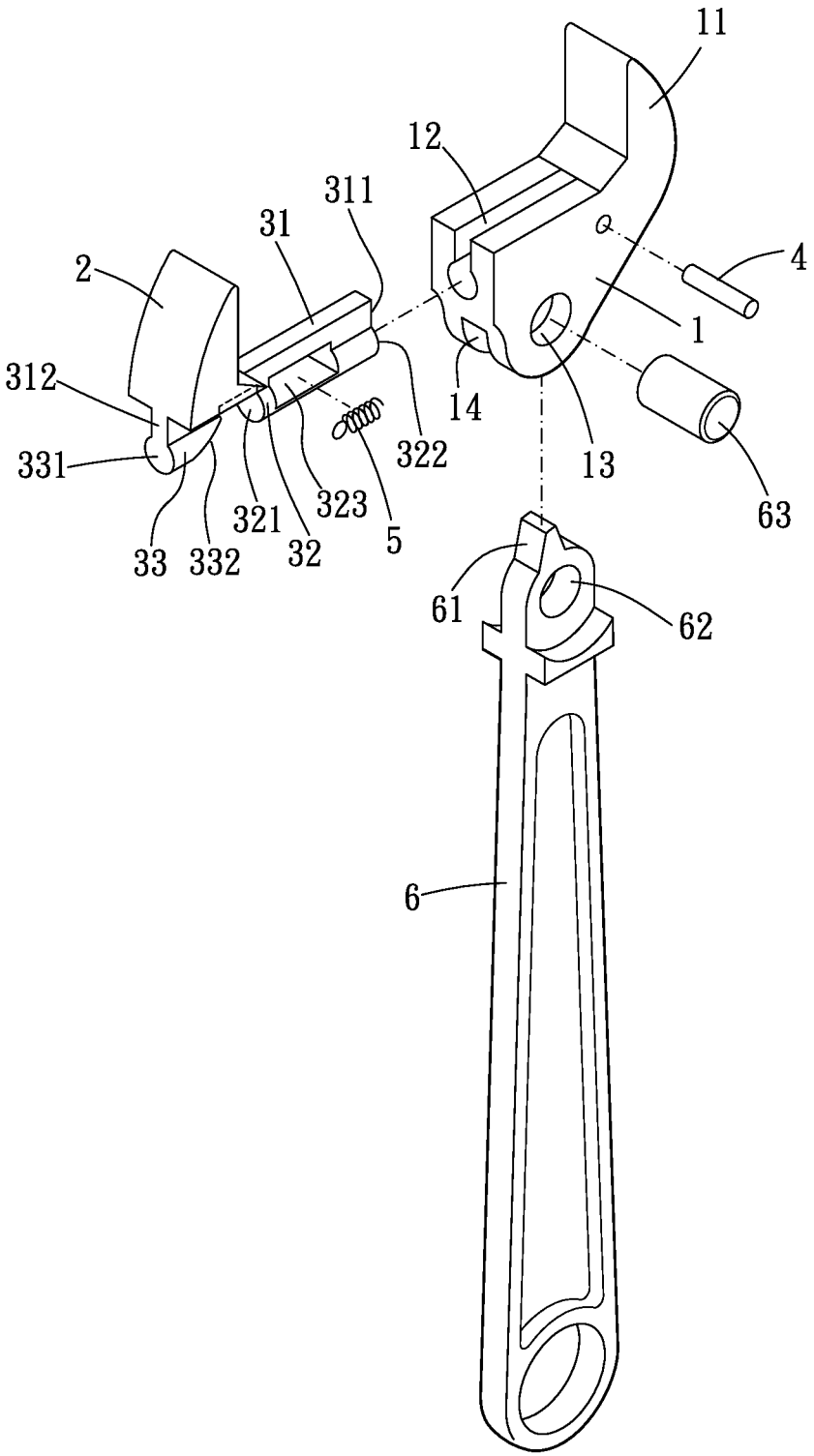
FIG. 1 is an explosion diagram of the present invention.
Figure 2:
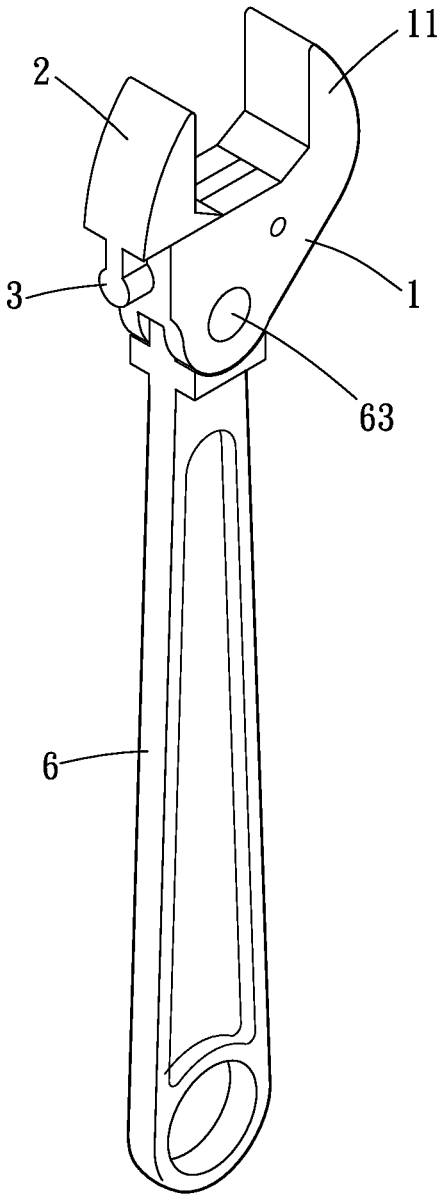
FIG. 2 is a stereogram of the present invention.
Figure 3:
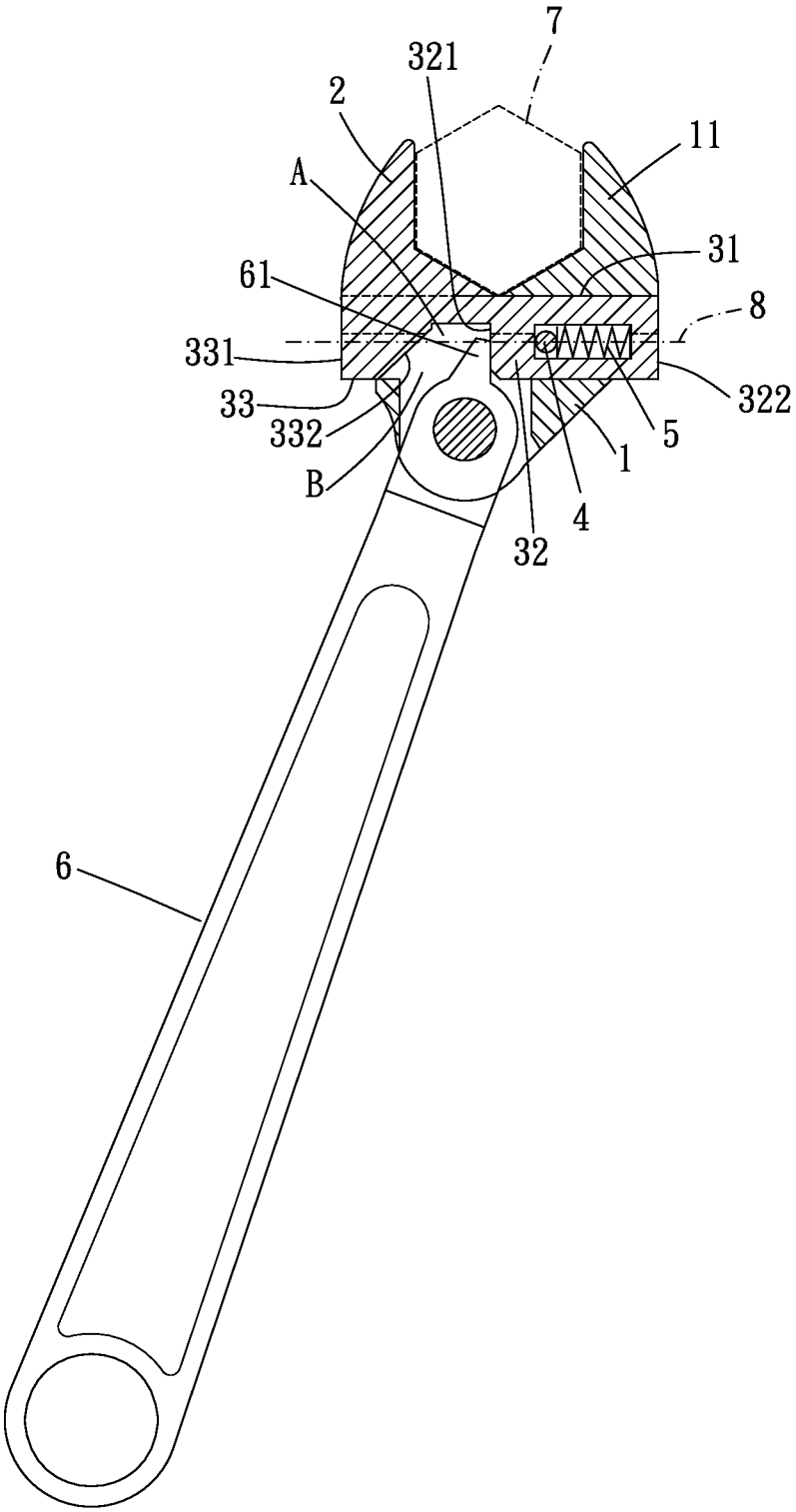
FIG. 3 is a drawing showing a wrench driving a nut according to the present invention.

As shown in FIGS. 1 to 3, a wrench of the present invention includes a main body 1, a movable jaw 2, a slidable member 3, a blocking member 4, a spring member 5 and a handle 6.

The main body 1 has a fixed jaw 11. The main body 1 may further include a sliding slot 12, a through hole 13 and a through recess 14 for the assembly of other parts. The sliding slot 12, the through hole 13 and the through recess 14 communicate with each other, and the through hole 13 is located between the sliding slot 12 and the through recess 14. In addition, an axis of the through hole 13 is perpendicular to the direction in which the sliding slot 12 extends.

The slidable member 3 is integrally formed at the bottom portion of the movable jaw 2 and slidably mounted to the main body 1, more specifically, slidably mounted in the sliding slot 12 of the main body 1. The movable jaw 2 defines a changeable opening with the fixed jaw 11, and the width of the changeable opening can change when the slidable member 3 slides, thus allowing the clamping of a nut, a screw or the like, as shown in FIG. 3. The direction toward which the changeable opening faces is defined as a direction a clamping direction, that is, the clamping direction directs from the changeable opening and away from the main body 1. A sliding axis is defined according to a longitudinal direction of the slidable member 3. Since the slidable member 3 is slidably mounted in the sliding slot 12, the sliding axis along which the slidable member 3 slides is substantially parallel to the direction in which the sliding slot 12 extends. The sliding axis is preferably perpendicular to the clamping direction.

Preferably, the slidable member 3 includes an upper small portion 31 and a first lower enlarged portion 32. The upper small portion 31 integrally extends laterally from and is located at the bottom portion of the movable jaw 2, and has a first end 311 and a second end 312. The first lower enlarged portion 32 integrally extends laterally from and is located at the bottom portion of the upper small portion 31, and is near the first end 311 of the upper small portion 31. The extending length of the first lower enlarged portion 32 is smaller than that of the upper small portion 31, and the first lower enlarged portion 32 has a first end 321 and a second end 322. The first lower enlarged portion 32 has a slot 323 extending laterally along a longitudinal axis thereof, and the longitudinal axis is substantially parallel to the sliding axis. A central line 8 is defined according to a direction in which the slot 323 extends. A part of the upper small portion 31 near the second end 312 thereof and the first end 321 of the first lower enlarged portion 32 define a driving space A, and an another part of the upper small portion 31 and the main body 1 define an evading space B, wherein the central line 8 passes through the driving space A. The evading space B is comparatively near the second end 312 of the upper small portion 31 and communicates with the driving space A. Preferably, the slidable member 3 further includes a second lower enlarged portion 33 integrally extending laterally from and is located at the bottom portion of the upper small portion 31 and is near the second end 312 of the upper small portion 31. In other words, the second lower enlarged portion 33 is located at the another part near the second end 312 of the upper small portion 31. The second lower enlarged portion 33 has a first end 331 and a second end 332. The first end 331 of the second lower enlarged portion 33 is near the second end 312 of the upper small portion 31, and the second end 332 of the second lower enlarged portion 33 is formed with a chamfer, wherein the chamfer and the main body 1 define the evading space B.

The blocking member 4 is connected to the main body 1, located in the slot 323 and near the first end 311 of the first lower enlarged portion 32. The blocking member 4 is preferably a pin.

The spring member 5 is disposed in the slot 323, and two ends of the spring member 5 engage against the blocking member 4 and a sidewall of slot 323, respectively, in which the sidewall is near the second end 322 of the first lower enlarged portion 32.

The handle 6 is rotatably mounted to the main body 1 and has a toggle member 61 disposed at one end thereof. The toggle member 61 is preferably a single projection. In this embodiment, the toggle member 61 is a single projection protruding from one end of the handle 6, and the end of the handle 6 is formed with a round hole 62. In fabrication, the toggle member 61 is disposed into the through recess 14, and a pin 63 is disposed through the through hole 13 of the main body 1 and the round hole 62 of the handle 6, so that the handle 6 can rotate around the pin 63 between a driving position and a releasing position. In addition, since the axis of the through hole 13 is perpendicular to the direction in which the sliding slot 12 extends, the direction in which the pin 63 extends is perpendicular to the sliding axis.

The operation of the wrench of the present invention for driving the nut 7 is described as following. As shown in FIG. 3, the handle 6 is rotated clockwise, the toggle member 61 is within the driving space A and engages against the first end 321 of the first lower enlarged portion 32 as the handle 6 is at the driving position, so that the changeable opening is retained to have the smallest width, so as to help the movable jaw 2 and the fixed jaw 11 to engage with two side surfaces of the nut 7 with a specific dimension. Through repeatedly rotating the handle 6 clockwise by the user, the nut 7 is screwed or unscrewed. Preferably, the central line 8 passes through the toggle member 61 as the toggle member 61 engages against the first end 321 of the first lower enlarged portion 32, so that the force applied by the user can be sufficiently delivered to the movable jaw 2 and the fixed jaw 11.

Figure 4:
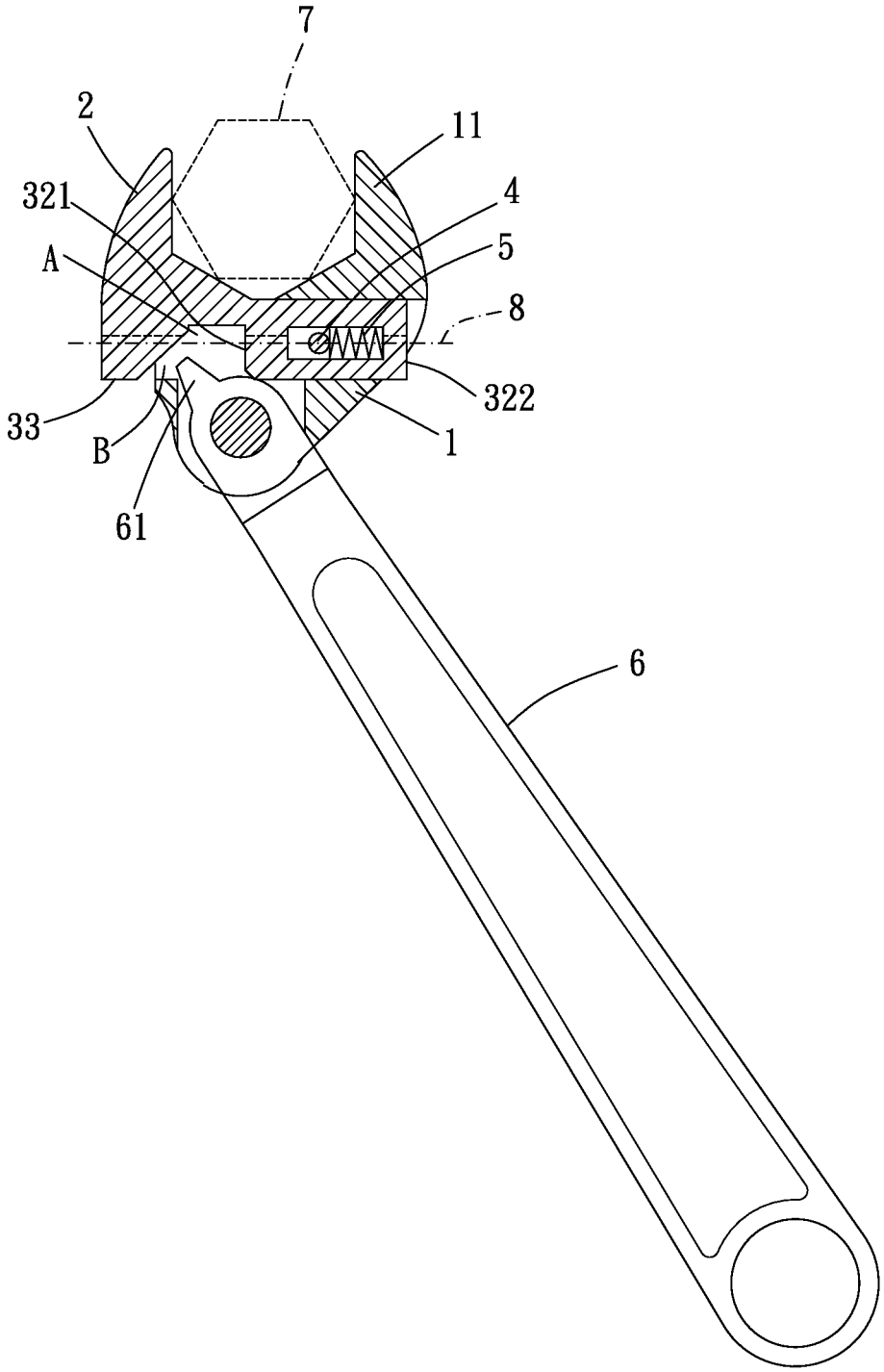
FIG. 4 is a stereogram showing a movable jaw moving away from a fixed jaw according to the present invention.

As shown in FIG. 4, as the handle 6 is rotated counterclockwise to at the releasing position, the toggle member 61 is located away from the first end 321 of the first lower enlarged portion 32 and moves freely into the evading space B from the driving space A, meanwhile, the movable jaw 2 is capable of being moved away from or toward the fixed jaw 11. The nut 7 or the like retained within the changeable opening can force the movable jaw 2 away and is capable of rotating freely. The spring member 5 provides a spring force to force the movable jaw 2 to tend to move toward the fixed jaw 11. That is, the movable jaw 2 tends to slide toward the fixed jaw 11 so as to reduce the width of the changeable opening, whereby lightly retaining the part within the changeable opening. In this embodiment, the toggle member 61 traverses through the evading space B and engages against the main body 1, and the toggle member 61 is limited by the main body 1 so as to avoid driving the handle 6 for an overstepping travel angle.

The wrench of the present invention is simple in structure. In addition, it needs only to rotate the handle to enable the toggle member to engages against the first end of the first lower enlarged portion, so as to retain the nut or the like in an assembly or disassembly process. With the simple structure, the invention has characteristics of easy manufacturing, low manufacturing costs, lower-threshold requirements for skill, smaller gap(s) between parts and high stability, and this facilitates the manufacture of the wrench and it has excellent effects of use. More important, the invention is free of the disadvantageous issues of gear engagement and gear slippage when the gears engage with or disengage from each other, and the wrench is of better tactile property and high quality.

Furthermore, the slidable member is provided with the evading space, and the evading space allows the toggle member move into or even to traverse through. The spring force provided by the spring member disposed in the slot can force the movable jaw to tend to move toward the fixed jaw, and the travel distance for which the movable jaw moves away from the fixed jaw is not limited.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wrench, including:

a main body, having a fixed jaw;

a movable jaw;

a slidable member, formed at the bottom portion of the movable jaw and slidably mounted to the main body, the movable jaw defining a changeable opening with the fixed jaw, a sliding axis being defined according to a longitudinal direction of the slidable member, and the width of the changeable opening changing when the slidable member slides, wherein the slidable member includes an upper small portion and a first lower enlarged portion, the upper small portion extends laterally from and is located at the bottom portion of the movable jaw, the upper small portion has a first end and a second end, the first lower enlarged portion extends laterally from and is located at the bottom portion of the upper small portion and is near the first end of the upper small portion, the extending length of the first lower enlarged portion is smaller than that of the upper small portion, the first lower enlarged portion has a first end and a second end, a part of the upper small portion near the second end thereof and the first end of the first lower enlarged portion define a driving space, an another part of the upper small portion and the main body define an evading space, and the evading space is comparatively near the second end of the upper small portion and communicates with the driving space; and a handle, rotatably mounted to the main body, having a toggle member disposed at one end thereof, and being rotatable between a driving position and a releasing position, wherein when the handle is at the driving position, the toggle member is located in the driving space and engages against the first end of the first lower enlarged portion, and the changeable opening has the smallest width, when the handle is at the releasing position, the toggle member is located away from the first end of the first lower enlarged portion and moves freely into the evading space from the driving space, and the movable jaw is capable of being moved away from or toward the fixed jaw.

2. The wrench of claim 1, further including a spring member which provides a spring force to force the movable jaw to tend to move toward the fixed jaw.

3. The wrench of claim 1, wherein the slidable member further includes a second lower enlarged portion which integrally extends laterally from and is located at the bottom portion of the upper small portion and is near the second end of the upper small portion, the second lower enlarged portion has a first end and a second end, the first end of the second lower enlarged portion is near the second end of the upper small portion, the second end of the second lower enlarged portion is formed with a chamfer, and the chamfer and the main body define the evading space.

4. The wrench of claim 1, further including a blocking member, wherein the first lower enlarged portion has a slot extending laterally along a longitudinal axis thereof, the longitudinal axis is substantially parallel to the sliding axis, the blocking member is connected to the main body, located in the slot and near the first end of the first lower enlarged portion, the spring member is disposed in the slot, and two ends of the spring member engage against the blocking member and a sidewall of the slot, respectively, in which the sidewall is near the second end of the first lower enlarged portion.

5. The wrench of claim 4, wherein a central line which passes through the driving space is defined according to a direction in which the slot extends.

6. The wrench of claim 5, wherein the central line passes through the toggle member as the toggle member engages against the first end of the first lower enlarged portion.

7. The wrench of claim 1, wherein the toggle member is a single projection.

* * * * *